US006144830A

United States Patent [19]

Kusaba et al.

[11] Patent Number: 6,144,830

[45] Date of Patent: Nov. 7, 2000

[54] INTERMEDIATE TRANSFER MEMBER AND ELECTROPHOTOGRAPHIC APPARATUS INCLUDING SAME

[75] Inventors: Takashi Kusaba, Shizuoka-ken; Hiroyuki Kobayashi, Fuji; Minoru Shimojo, Kawasaki; Akihiko Nakazawa, Kanagawa-ken; Akira Shimada; Atsushi Tanaka, both of Susono; Tsunenori Ashibe, Yokohama, all of Japan

[73] Assignee: Canon Kabushiki Kaisha, Tokyo, Japan

[21] Appl. No.: 08/780,773

[22] Filed: Jan. 9, 1997

[30] Foreign Application Priority Data

Jan. 10, 1996 [JP] Japan ..... 8-002164
May 31, 1996 [JP] Japan ..... 8-138703

[51] Int. Cl.[7] ..... G03G 15/00; G03G 15/16

[52] U.S. Cl. ..... 399/302; 399/308

[58] Field of Search ..... 399/302, 308, 399/307, 313; 430/126

[56] References Cited

U.S. PATENT DOCUMENTS

| | | | |
|---|---|---|---|
| 4,000,942 | 1/1977 | Ito et al. | 399/398 |
| 5,530,532 | 6/1996 | Iino et al. | 399/237 |
| 5,669,052 | 9/1997 | Kusaba et al. | 399/308 |
| 5,745,831 | 4/1998 | Nakazawa et al. | 399/308 |
| 5,752,130 | 5/1998 | Tanaka et al. | 399/308 X |

FOREIGN PATENT DOCUMENTS

| | | |
|---|---|---|
| 2 715 483 | 7/1995 | France . |
| 57-008569 | 1/1982 | Japan . |
| 63-301960 | 12/1988 | Japan . |
| 7-72740 | 3/1995 | Japan . |
| 8-160759 | 6/1996 | Japan . |

*Primary Examiner*—Sophia S. Chen
*Attorney, Agent, or Firm*—Fitzpatrick, Cella, Harper & Scinto

[57] ABSTRACT

An intermediate transfer member is formed by at least a base layer and a surface layer. The base layer is formed by epichlorohydrin rubber and acrylonitrile-butadiene rubber mixed in a certain weight ratio (preferably 1:9 to 9:1). The surface layer is formed by urethane resin or elastomer and a fluorine-containing compound powder. The fluorine-containing compound powder may preferably be contained in an amount of 20–80 wt. % based on the surface layer. The intermediate transfer member is suitable for full-color image formation by electrophotography and is effective in improving a transfer performance and providing clear images without causing transfer failure even in repetitive use for a long period.

16 Claims, 4 Drawing Sheets

INTERMEDIATE TRANSFER MEMBER AND ELECTROPHOTOGRAPHIC APPARATUS INCLUDING SAME

FIELD OF THE INVENTION AND RELATED ARTS

The present invention relates to an intermediate transfer member for temporarily holding an image in an image forming process according to electrophotography, and an electrophotographic apparatus including the intermediate transfer member.

An electrophotographic apparatus including an intermediate transfer member is very effective for forming a color image by sequentially superposing and transferring a plurality of component color images. For example, it is possible to decrease color deviation in superposing respective color toner images compared with a transfer process described in Japanese Laid-Open Patent Application (JP-A) 63-301960. Moreover, it is possible to transfer an image from the intermediate transfer member onto a recording medium or transfer-receiving material without necessitating holding means, such as glipper means, sucking means or curvature means (as disclosed in FIG. 1 of JP-A 63-301960), so that the recording medium can be selected from a wide variety of materials, including thin paper (40 $g/m^2$) to thick paper (200 $g/m^2$), wide to narrow medium, and long to short medium. Accordingly, transfer can be performed onto an envelope, a post card and even label paper, etc.

Because of such advantageous features, color copying machines and color printers using intermediate transfer members have already been available on the market.

However, a conventional intermediate transfer member has caused the following difficulties when actually used repetitively in various environments.

(1) When the intermediate transfer member is used for a long period of time, the transfer efficiency from a photosensitive drum to the intermediate transfer member and the transfer efficiency from the intermediate transfer member to, e.g., paper or an OHP sheet are lowered. For this reason, in order to effect cleaning of a large amount of a transfer residual toner, the load on the photosensitive drum, the intermediate transfer member or a cleaning device becomes large, thus shortening the life of these members. In addition, the cleaning device is considerably complicated in structure and also becomes expensive.

(2) The intermediate transfer member deteriorates by, e.g., ozone with repetitive use thereof to change its surface property and its resistance in some cases. If the intermediate transfer member is considerably deteriorated, cracks in an elastic layer and a coating layer of the intermediate transfer member and a peeling of a surface layer thereof are caused, thus failing to maintain a good transfer efficiency and a uniform image obtained at an initial stage.

SUMMARY OF THE INVENTION

An object of the present invention is to provide an intermediate transfer member excellent in transfer efficiency and durability.

Another object of the present invention is to provide an electrophotographic apparatus including such an intermediate transfer member and capable of providing clear images without causing a transfer failure of a toner even when used for a long period.

According to the present invention, there is provided an intermediate transfer member, comprising: at least a base layer and a surface layer, wherein the base layer comprises epichlorohydrin rubber and acrylonitrile-butadiene rubber, and the surface layer comprises urethane resin or urethane elastomer and comprises a fluorine-containing compound powder.

According to the present invention, there is further provided an electrophotographic apparatus, comprising:

an electrophotographic photosensitive member, charging means for charging the electrophotographic photosensitive member, imagewise exposure means for exposing imagewise the charged electrophotographic photosensitive member to form an electrostatic latent image, developing means for developing the electrostatic latent image to form a toner image on the electrophotographic photosensitive member, and the above-mentioned intermediate transfer member for temporarily receiving the toner image by transfer from the electrophotographic photosensitive member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, the intermediate transfer member according to the present invention will be described with respect to some embodiments in the form of a drum but need not be restricted to such a drum form.

Figure 1:
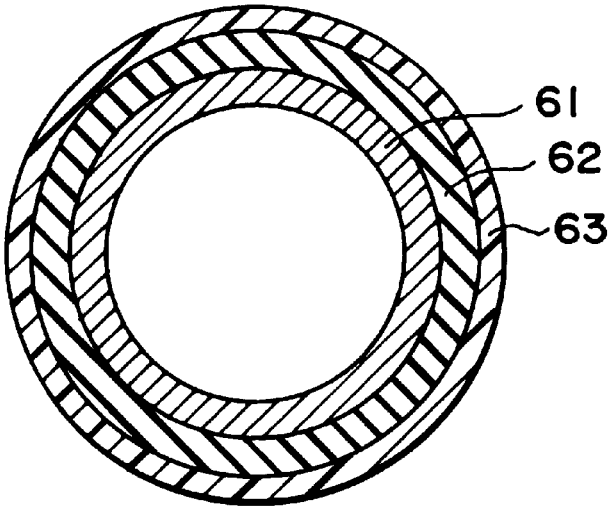
FIG. 1 is a perspective view for illustrating an embodiment of the intermediate transfer member according to the invention.

FIG. 1 is a perspective illustration of an embodiment of the intermediate transfer member according to the present invention. Referring to FIG. 1, the intermediate transfer member comprises an electroconductive support 61 in the form of a cylinder, a base layer 62 disposed thereon, and a surface layer 63 disposed on the base layer 62. In the case of an intermediate transfer member in the form of a belt, the support 61 is not used.

The surface layer 63 comprises a fluorine-containing compound powder and a binder. By incorporating the fluorine-containing powder, the surface of the intermediate transfer member is provided with a sufficient lubricating property, thus improving secondary transferability (transferability of a toner image from the intermediate transfer member to a secondary image-carrying member, such as a recording paper) and a durability. Further, it is possible to prevent the occurence of a filming phenomenon thereby to reduce abrasion of a photosensitive member.

The binder for the surface layer 63 may preferably have a property allowing a sufficient mixing and dispersion of the fluorine-containing compound powder. If the binder is not appropriately selected, the fluorine-containing compound powder is not dispersed or is dispersed but results in a brittle state, so that the resultant surface layer is liable to be cracked or damaged with repetitive use and becomes non-uniform in the case of a remarkable dispersion failure. Further, the surface layer is accompanied has a problem that the fluorine-containing compound powder, once incorporated into the surface layer, is dropped out to provide a roughened surface thereto and a lowering in transfer efficiency.

In view of the above circumstances, the binder of the surface layer may preferably comprise a urethane resin or a urethane elastomer exhibiting a sufficient strength and dispersibility.

Such a urethane resin or a urethane elastomer used as the binder of the surface layer in the present invention may preferably have an elongation of at least 150%, a tensile strength of at least 300 kgf/cm$^2$ and a tensile stress of at most 250 kgf/cm$^2$ at an elongation of 100%, as measured according to JIS K-6301, in order to further improve durability of the surface layer. The urethane resin or the urethane elastomer may more preferably have an elongation of at least 250%, a tensile strength of at least 400 kgf/cm$^2$ and a tensile stress of at most 200 kgf/cm$^2$ at an elongation of 100%; further preferably an elongation of at least 350%, a tensile strength of at least 450 kgf/cm$^2$ and a tensile stress of at most 150 kgf/cm$^2$ at an elongation of 100%.

The fluorine-containing compound powder described above may preferably be contained in the surface layer in an amount of 20–80 wt. %, more preferably 30–70 wt. %, based on the surface layer. If the content is below 20 wt. %, the impartment of lublicity to the surface layer becomes insufficient, thus resulting in a lowering in secondary transfer efficiency and the occurrence of filming. If the content exceeds 80 wt. %, a resultant surface layer becomes brittle and lowers its adhesiveness to an underlying layer, thus causing deficiencies, such as peeling or cracking with respect to the surface layer in repetitive use for a long period.

Examples of the fluorine-containing compound powder may include powders of resins, such as tetrafluoroethylene resin, trifluorochloroethylene resin, tetrafluoroethylene-hexafluoropropylene resin, vinyl fluoride resin, vinylidene fluoride resin, difluorodichloro-ethylene resin, copolymers of the above resins, and fluorinated carbon. These may be used singly or in combination of two or more species. Among these, tetrafluoroethylene resin (PTFE) powder is particularly preferred.

The fluorine-containing compound powder may appropriately be selected from commercially available powders of the above resins so as to have a desired molecular weight and a desired particle size. The fluorine-containing compound powder may preferably have a relatively lower molecular weight (e.g., weight-average molecular weight (Mw) of $10^4$–$10^5$, particularly $10^4$–$5\times10^4$) in view of the lubricity of the surface layer and may preferably have an average particle size of 0.02–5 $\mu$m, more preferably 0.05–10 $\mu$m, further preferably 0.1–1.0 $\mu$m.

The above-described fluorine-containing compound powder may be mixed and dispersed in the binder (e.g., urethane resin or elastomer) by appropriately using a known mixing device. More specifically, in the case of using a urethane elastomer as the binder, a mixing device, such as a roll mill, a kneader or a Banbury mixer, may preferably be used. If a liquid urethane binder is used, a mixing device, such as a ball mill, a bead mill, a homogenizer, a paint shaker, a nanomizer or the like may preferably be adopted.

The base layer 62 of the intermediate transfer member of the present invention comprises epichlorohydrin rubber and acrylonitrile-butadiene rubber (NBR).

These rubbers are selected from rubbers and elastomers showing a solubility parameter (SP) value closer to those of the urethane resin or the urethane elastomer used as the binder for the surface layer 63 in view of an adhesiveness between the base layer 62 and the surface layer 63. As a rubber or elastomer showing an SP value close to that of the urethane resin or elastomer, NBR or urethane rubber may generally be exemplified. However, a base layer consisting of NBR alone is inferior in ozone resistance and causes therein, e.g., a crack or a fissure when used for a long period. Accordingly, in the present invention, by mixing NBR with epichlorohydrin rubber having a good ozone resistance and a good mutual solubility with not only NBR but also the urethane resin or elastomer as the surface layer binder, it is possible to provide an intermediate transfer member having good adhesiveness of the base layer to the surface layer and excellent ozone resistance. In addition, both of NBR and epichlorohydrin rubber have a relatively low electrical resistance. Accordingly, by using these rubbers in combination to constitute the base layer, it is possible to control an electric resistance of a resultant intermediate transfer member to some extent without dispersing an electroconductive filler within the base layer, thus resulting in a intermediate transfer member with little irregularity in resistance.

The above-mentioned epichlorohydrin rubber (hereinafter sometimes referred to as "CHR") and NBR may preferably be mixed in a mixing ratio by weight of (CHR:NBR)=1:9 to 9:1, more preferably 6:4 to 8:2. In case where CHR is used in a small amount and NBR is used excessively, the resultant intermediate transfer member has an insufficient ozone resistance to cause a deficiency, such as a crack in the base layer in some cases. In case where CHR is used excessively and NBR is used to a small extent, the base layer has a poor adhesiveness to the surface layer to cause a peeling of the surface layer in some cases when used for a long period.

Examples of epichlorohydrin rubber (CHR) used in the present invention may include epichlorohydrin homopolymer, epichlorohydrin-ethylene oxide copolymer, epichlorohydrin-allyl glycidyl ether copolymer and epichlorohydrin-ethylene oxide-allyl glycidyl ether terpolymer.

In the base layer, CHR and NBR may preferably be used in a total amount of 60–100 wt. %, more preferably 80–100 wt. %, based on a binder component of the base layer.

The base layer used in the present invention may preferably have a hardness of 10–70 degrees, and more preferably 20–55 degrees, as measured according to JIS-A.

The electroconductive support 61 may preferably comprise a metal or alloy, such as aluminum, iron, copper or stainless steel, or an electroconductive resin containing electroconductive carbon or metal particles dispersed therein. The support may have the shape of a drum or a belt as described above, inclusive of a drum equipped with a shaft piercing therethrough and a drum inside of which has been reinforced.

In the present invention, in order to control the electrical resistance of the intermediate transfer member, powders of electroconductive materials, such as carbon black, graphite, carbon fiber, metal compounds, organic metal salts and electroconductive polymers, may be added in the base layer and/or the surface layer.

The intermediate transfer member according to the present invention may preferably have an electrical resistance of $10^1$–$10^{13}$ ohm, and particularly $10^2$–$10^{10}$ ohm.

Incidentally, the life of the intermediate transfer member may be determined by several factors one of which is a lowering in transfer characteristics due to a change in resistance.

The intermediate transfer member is generally prepared by controlling electrical properties represented by a resistance so as to provide optimum transfer characteristics but in many case, is gradually changed in its resistance by, e.g., voltage application in repetitive use for a long period. Such a change in resistance can be corrected to a certain degree by using, e.g., a transfer voltage-adjusting mechanism provided within an apparatus body of a printer or a copying machine. However, if the resistance change is not within an allowable range, appropriate transfer characteristics cannot be attained, thus requiring replacement of the intermediate transfer member.

In view of the above factor, in the present invention, the intermediate transfer member may preferably have resistances R1 (ohm) and R2 (ohm) satisfying the following relationships:

$0.1 \leqq R2/R1 \leqq 10$ and $5.0\times10^4$ ohm $\leqq R2 \leqq 5.0\times10^9$ ohm, wherein R1 denotes an initial resistance (ohm) of the intermediate transfer member and R2 denotes a resistance (ohm) after a direct current of 5 mA is continuously applied for 5 hours per a surface area of the intermediate transfer member of 1 $m^2$.

In a more preferred embodiment, the intermediate transfer member may preferably satisfy the following relationship:

$0.5 \leqq R2/R1 \leqq 5$.

When the resistance (electrical resistance) of the intermediate transfer member is increased in long term use, it is necessary to increases the transfer voltage in order to maintain the transfer efficiency, thus resulting in a large-sized apparatus. Further, if the resistance of the intermediate transfer member is considerably increased compared with an initial value thereof, a lowering in transfer efficiency cannot be suppressed only by control and adjustment on the apparatus body side. As the result, a transfer efficiency of a toner is lowered, thus causing a lowering in image density and an increase in transfer residual toner (developer) on the surface of the intermediate transfer member.

On the other hand, the resistance of the intermediate transfer member is lowered in some cases in long term use. For instance, the use of a large amount of a high electroconductive material causes a lowering of the resistance. In this case, a local electroconductive path is formed by repetitive voltage application for a long period, whereby the withstand voltage of the intermediate transfer member is lowered to cause a so-called leak. As a result, the lack of image due to a local transfer failure or a lowering in an overall transfer efficiency leading to a cleaning failure are caused.

This phenomenon is found to be largely affected by the amount of a current rather than the magnitude of the applied voltage. Accordingly, it is possible to expect a possibility of a fluctuation in resistance in long term use by applying an excessive current for several hours.

In this respect, the resistance R2 of the intermediate transfer member after the current application may desirably be set in the above-described range ($5.0\times10^4$–$5.0\times10^9$ ohm), particularly in a range from $5.0\times10^5$ ohm to $1.0\times10^9$ ohm, in order to retain a good transfer efficiency even after the long term use and obviate a large-sized apparatus body to reduce the cost of an apparatus body.

In order to control the change in resistance of the intermediate transfer member of the present invention, the above-mentioned electroconductive powder may appropriately be selected and mixed in the intermediate transfer member or the amounts of electroconductive powders and binders for respective layers may appropriately be controlled by forming the base layer and/or the surface layer each in plural layers, thus suppressing the resistance change. It is also possible to minimize the resistance change by controlling, e.g., the dispersion state of respective constituents (e.g., electroconductive powder).

The electrical resistances at an initial stage (R1) and after the current application (R2) of the intermediate transfer member referred to herein is based on values measured in the following manner. Further, the current application at that time is effected in the manner shown below successively.

<Measurement of resistance>

Figure 2:
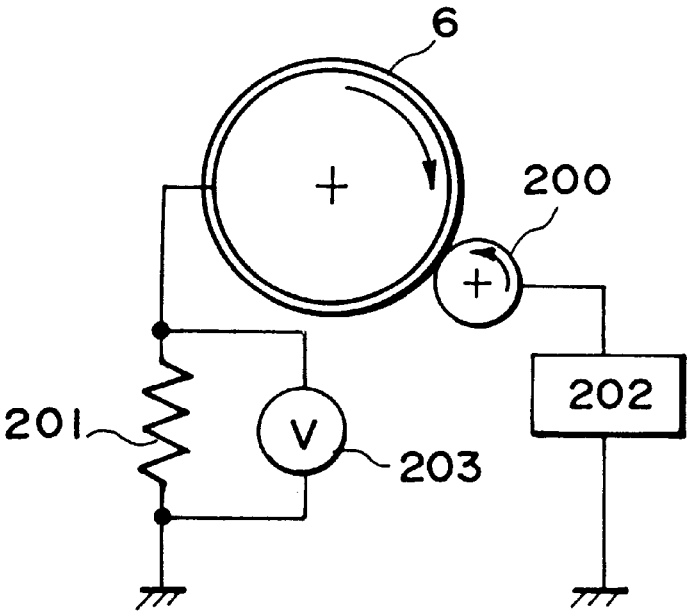
FIG. 2 is a view for illustrating a method for measuring the electric resistance of an intermediate transfer member.

(1) Under an environment of 23° C. and 65% RH, an intermediate transfer member 6 and a metal roller 200 (outer diameter=40 mm) are pressed against each other at a linear pressure of 40 g/cm while keeping respective shafts (axes) in parallel and are connected to a DC power supply 202, a resistor 201 disposed on a downstream side of the intermediate transfer member 6, and a potentiometer 203, as shown in FIG. 2. In the case of the intermediate transfer member 6 in the form of a belt, an aluminum cylinder having an outer diameter corresponding to an inner diameter of the belt is used as a core member and subjected to the measurement.

(2) The metal roller 200 is driven in rotation so that the mating intermediate transfer member 6 is rotated at a peripheral speed of 120 mm/sec.

(3) A constant voltage of 1 kV is applied from the DC power supply 202 to read a potential difference Vr between both terminals of the resistor 201 having a known resistance value sufficiently lower than the measurement sample by the potential meter 203.

(4) A current I is calculated from the measured potential difference Vr. The resistance of the intermediate transfer member 6 is calculated as applied voltage (1 kV)/current I.

<Application of current>

(1) Similarly as in the above manner, the intermediate transfer member 6 is disposed and driven in rotation.

(2) An applied direct current is adjusted so as to be a constant current of 5 mA per a surface area of 1 $m^2$ with respect to the intermediate transfer member 6. The direct current application is continued for 5 hours.

The base layer of the intermediate transfer member may preferably have a thickness of at least 0.5 mm, and more preferably at least 1 mm, particularly 1–10 mm. The surface layer of the intermediate transfer member may preferably have a thickness sufficiently small so as not to impair the resilience of the base layer, more specifically at most 1 mm, and further and preferably at most 500 $\mu$m, particularly 5–100 $\mu$m.

The intermediate transfer member according to the present invention may be produced, e.g., in the following manner.

First of all, a metal roller as a cylindrical electroconductive support (core metal) is provided. A rubber is molded or formed into a base layer to be disposed on the metal roller by melt molding, injection molding, dip coating, spray coating, etc. A material for a surface layer is molded or formed into a surface layer to be disposed on the base layer by melt molding, injection molding, dip coating, roller coating, spray coating, etc., to prepare an intermediate transfer member.

An electrophotographic apparatus will now be described with reference to FIG. 3.

The apparatus includes a rotating drum-type electrophotographic photosensitive member (hereinafter called "photosensitive drum") 1 repetitively used as a first image-bearing member, which is driven in rotation in a clockwise direction indicated by an arrow at a prescribed peripheral speed (process speed). The photosensitive drum 1 may preferably be one having an outermost layer (protective layer) containing particles of polytetrafluoroethylene (PTFE) (tetrafluoroethylene resin), so as to improve the transfer characteristic from the photosensitive drum as the first image-bearing member (primary transferability), thus attaining a good image quality free from image defects, such as a hollow dropout and a high primary transfer efficiency. For instance, if the transfer characteristic from the intermediate transfer member to a secondary image-bearing member such as recording paper (secondary transferability) is insufficient, the transfer residual toner on the intermediate transfer member is increased. As a result, the substantial transfer sufficiency is not improved and image defects, such as secondary transfer are caused to occur. However, the intermediate transfer member according to the present invention is not accompanied by such a problem and can improve substantial transfer efficiency and image quality in combination with the photosensitive drum using the protective layer.

During the rotation, the photosensitive drum 1 is uniformly charged to a prescribed polarity and potential by a primary charger (corona discharger) 2 and then exposed to imagewise light 3 (indicated by an arrow) supplied from an imagewise exposure means (not shown, e.g., an optical system including means for color separation-focusing exposure of a color original image, a scanning exposure system including a laser scanner for emitting laser beam modulated corresponding to time-serial-electrical-digital pixel signals of image data) to form an electrostatic latent image corresponding to a first color component image (e.g., a magenta color component image) of an objective color image.

Then, the electrostatic latent image is developed with a magenta toner M (first color toner) by a first developing device (magenta developing device 41 ). At this time, second to fourth developing devices (cyan developing device 42, yellow developing device 43 and black developing device 44 ) are placed in an operation-off state and do not act on the photosensitive drum 1, so that the magenta (first color) toner image, thus formed on the photosensitive drum 1, is not affected by the second to fourth developing devices 42, 43 and 44.

An intermediate transfer member 6 is rotated in a counterclockwise direction at a peripheral speed equal to that of the photosensitive drum 1.

As the magenta toner image formed and carried on the photosensitive drum 1 passes through a nip position between the photosensitive drum 1 and the intermediate transfer member 6, the yellow toner image is transferred onto an outer surface of the intermediate transfer member 6 under the action of an electric field caused by a primary transfer bias voltage applied to the intermediate transfer member 6 (primary transfer).

The surface of the photosensitive drum 1 after the transfer of the magenta (first color) toner image onto the intermediate transfer member 6 is cleaned by a cleaning device 5.

Thereafter, a cyan (second color) toner image, a yellow (third color) toner image and a black (fourth color) toner image are similarly formed on the photosensitive drum 1 and are successively transferred in superposition onto the intermediate transfer member 6 to form a synthetic color toner image corresponding to an objective color image.

A transfer roller 91 is supported on a shaft in parallel to the intermediate transfer member 6 and so as to be in contact with a lower (but outer) surface of the intermediate transfer member 6. During the sequential transfer steps for transferring the first to fourth color images from the photosensitive drum 1 onto the intermediate transfer member 6, the transfer roller 91 can be separated from the intermediate transfer member 6.

For the secondary transfer, the transfer roller 91 abuts against the intermediate transfer member 6, a transfer-receiving material 10 as a second image-bearing member is supplied via paper supply cassette 11 to a nip position between the intermediate transfer member 6 and the secondary transfer roller 91 at a prescribed time and, in synchronism therewith, a secondary transfer bias voltage is applied to the transfer roller 91 from a power supply 12. Under the action of the secondary transfer bias voltage, the synthetic color toner image on the intermediate transfer member 6 is transferred onto the transfer-receiving material (second image-bearing member) 10 (secondary transfer). The transfer-receiving material 10 carrying the toner image is introduced into a fixing device 13 to effect heat fixation of the toner image.

After completion of image transfer onto the transfer-receiving material 10, a transfer residual toner (a portion of toner remaining on the intermediate transfer member 6 without being transferred onto the transfer-receiving material 10) is cleaned by abutting a cleaner 7 against the intermediate transfer member 6.

Figure 4:
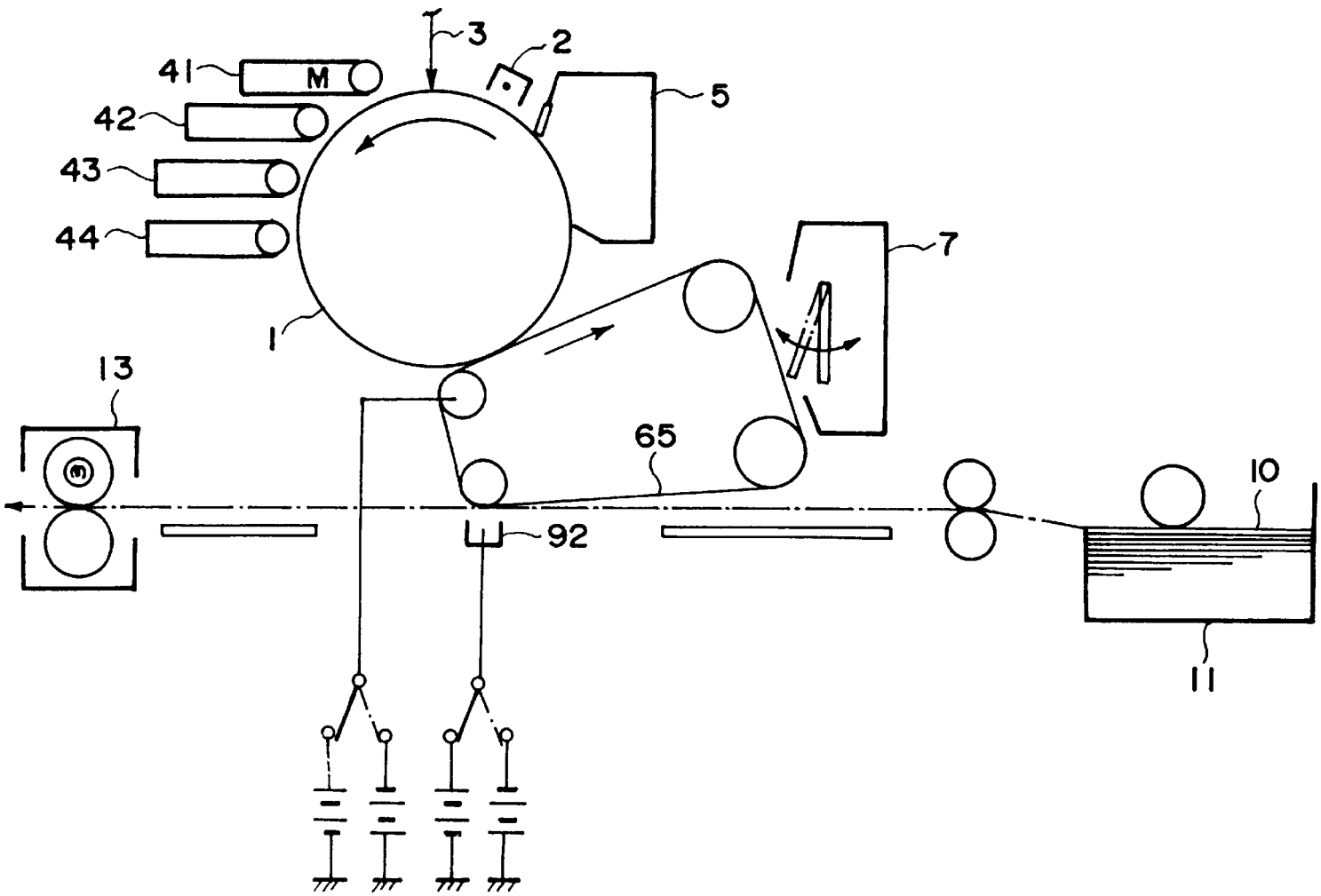

FIG. 4 shows another embodiment of the electrophotographic apparatus of the present invention.

Figure 3:
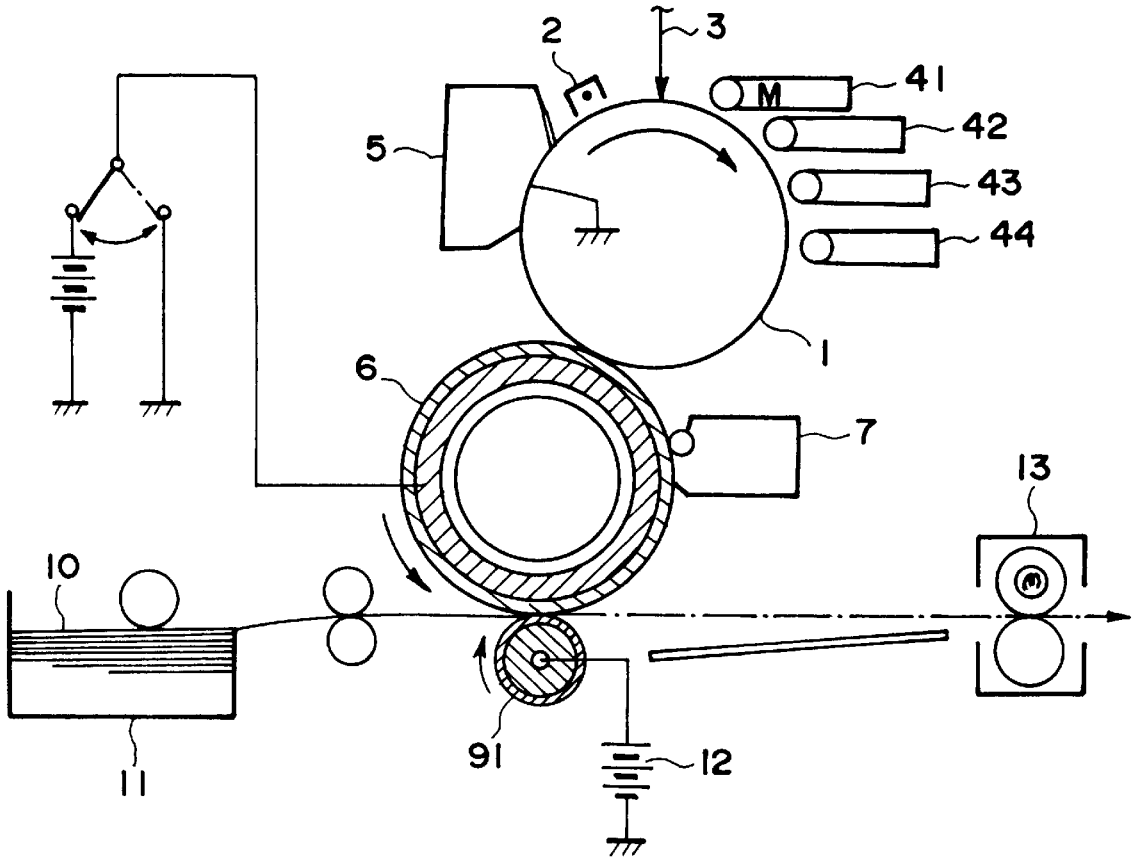
FIGS. 3 and 4 are side views each illustrating an embodiment of an electrophotographic apparatus according to the invention.

The apparatus employs similar structural members and systems as in the apparatus shown in FIG. 3 except that an intermediate transfer member 65, in the form of a belt and a transfer charger 92, are used instead of the intermediate transfer member 6 in the form of a drum and the transfer roller 91, respectively. Referring to FIG. 4, the intermediate transfer member 65 is supported by about four rollers.

Hereinbelow, the present invention will be described more specifically with reference to Examples and Comparative Examples, wherein "part(s)" used for describing a composition means "part(s) by weight".

EXAMPLE 1

On an aluminum cylinder (outer diameter (OD)=182 mm, length (L)=320 mm, thickness (T)=5 mm), a rubber compound of the following composition was transfer-molded to prepare a roller having a 5 mm-thick base layer.

| (Rubber compound) | |
|---|---|
| NBR | 35 parts |
| Epichlorohydrin rubber | 65 parts |
| Paraffin oil | 2 parts |
| Carbon black | 1 part |
| Calcium carbonate | 10 parts |
| Sulfur (vulcanizing agent) | 1 part |
| Zinc oxide (vulcanization aid) | 2 parts |
| Thiuram compound (vulcanization promoter) | 2 parts |

Separately, a surface layer paint of the following composition was prepared.

(Surface layer paint)

| | |
|---|---|
| Polyester polyurethane prepolymer (containing dimethylformamide) | 100 parts |
| Hardener (isocyanate containing ethyl acetate) | 4 parts |
| Tetrafluoroethylene resin powder (average particle size (Dav = 0.3 μm) | 100 parts |
| Dispersion aid | 5 parts |
| DMF (dimethylformamide | 120 parts |

The paint was applied by spraying onto the outer surface of the roller and dried at 80° C. for 1 hour, followed by curing (hardening) at 120° C. for 2 hours to form first and second intermediate transfer members each having an approximately 60 μm-thick tough surface layer. The tetrafluoroethylene powder occupied 55 wt. % of the total solid components of the surface layer.

The first intermediate transfer member was incorporated in a full-color electrophotographic apparatus as shown in FIG. 3 including an OPC photosensitive member (as a first image-bearing member) having a photosensitive layer and a protective layer thereon, and subjected to measurement of transfer efficiencies in an environment of temperature of 23° C. and humidity of 65% RH according to a mono-color mode using a cyan toner, thereby to obtain a primary transfer efficiency (from the photosensitive member to the intermediate transfer member) of 95% and a secondary transfer efficiency (from the intermediate transfer member to plain paper of 80 g/m$^2$ (as a secondary image-bearing member)) of 94%.

Herein, the respective transfer efficiencies are calculated according to the following equations.

Primary transfer efficiency (%)=[(Toner density on the intermediate transfer member)/(Residual toner density on the photosensitive member+Toner density on the intermediate transfer member)]×100

Secondary transfer efficiency (%)=[(Toner density on the plain paper)/(Residual toner density on the intermediate transfer member+Toner density on the plain paper)]×100

Then, by using the image forming apparatus, a continuous full-color image forming test in an environment of 23° C./65% RH was performed under the following conditions.

Photosensitive member: OPC photosensitive member having a laminar structure of an electroconductive support, an undercoating layer, a charge generation layer, a charge transportation layer and a protective layer containing tetrafluoroethylene resin powder.

Dark part potential: −750 volts

Developer: non-magnetic mono-component toners of four colors (cyan, magenta, yellow and black)

Primary transfer voltage: +700 volts

Secondary transfer voltage: +2500 volts

Process speed: 120 mm/sec

Developing bias voltage: −500 volts

As a result, a good image quality was confirmed.

Figure 5:
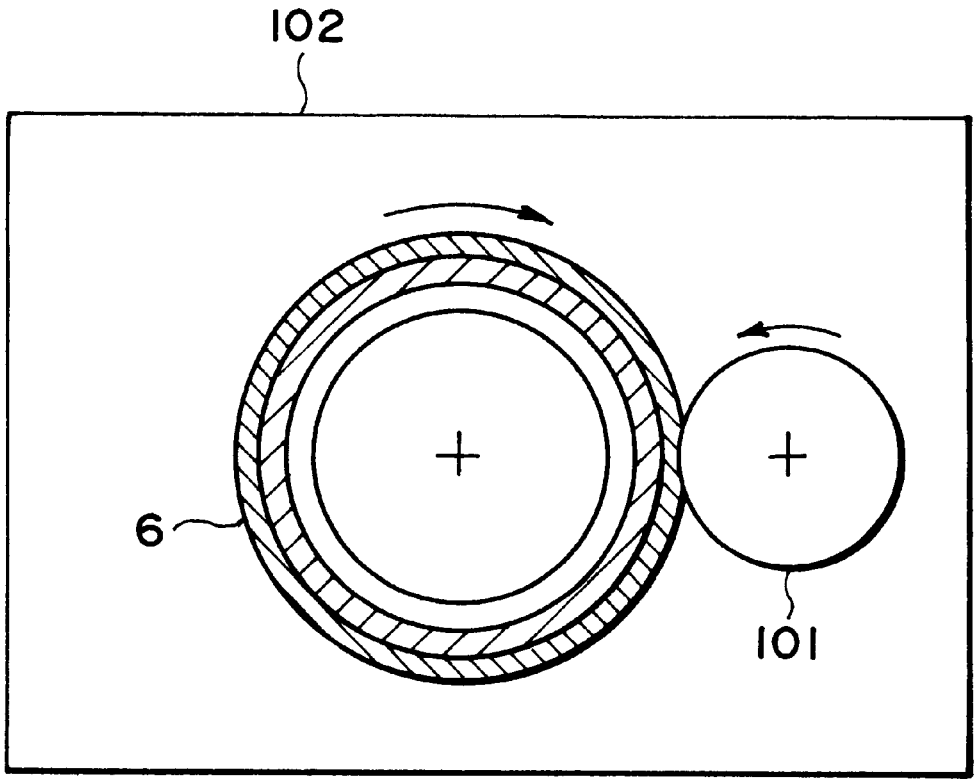
FIG. 5 is a side view for illustrating an embodiment of an apparatus for performing a durability test of the intermediate transfer member according to the invention.

Then, the first intermediate transfer member 6 was incorporated in a durability testing apparatus 102 as shown in FIG. 5 and was abutted on an aluminum cylinder 101 (outer diameter=80 mm) at a total pressure of 5 kg, followed by a continuous load rotation test of $10^5$ revolutions at a peripheral speed of 120 mm/sec. This test was performed at a constant ozone concentration of 10 ppm within the durability testing apparatus.

After the durability test, a continuous full-color image forming test was performed on 10,000 sheets of plain paper of 80 g/m$^2$, whereby images similar to those at the initial stage were obtained. The secondary transfer efficiency was 93% and accordingly, substantially no lowering in (secondary) transfer efficiency was caused. Further, as a result of evaluation of a surface state of the intermediate transfer member by eye observation, no peeling and crack were observed at the surface layer, and no toner filming was observed either.

Separately, the second intermediate transfer member prepared as described above was subjected to measurement of an initial resistance R1 and a resistance R2 after continuous direct current application (5 mA for 5 hours) in the above-described manner with reference to FIG. 2.

The results of this example are summarized in Table 1 appearing hereinafter.

EXAMPLE 2

Two (first and second) intermediate transfer members were prepared (and evaluated in the same manner as in Example 1) except that the composition of the rubber compound was changed as follows.

| (Ingredient) | (wt. part(s)) |
|---|---|
| NBR | 15 |
| Epichlorohydrin rubber | 85 |
| Paraffin oil | 2 |
| Carbon black | 1 |
| Calcium carbonate | 10 |
| Sulfur (vulcanizing agent) | 1 |
| Zinc oxide (vulcanization aid) | 2 |
| Thiuram compound (vulcanization promoter) | 2 |

With respect to the first intermediate transfer member, sufficient transfer efficiencies and a good image quality were obtained. Further, as a result of the continuous image formation of 10,000 sheets, a very slight peeling of the surface layer was observed and the transfer efficiencies were somewhat lowered when compared with those at the initial stage. However, these phenomena did not affect resultant images and were evaluated as a practically acceptable level.

The second intermediate transfer member was subjected to measurement of resistances R1 and R2.

The results are also shown in Table 1.

EXAMPLE 3

Two (first and second) intermediate transfer members were prepared (and evaluated in the same manner as in Example 1) except that the composition of the rubber compound was changed as follows.

| (Ingredient) | (wt. part(s)) |
|---|---|
| NBR | 85 |
| Epichlorohydrin rubber | 15 |
| Paraffin oil | 2 |
| Carbon black | 1 |
| Calcium carbonate | 10 |
| Sulfur (vulcanizing agent) | 1 |

-continued

| (Ingredient) | (wt. part(s)) |
|---|---|
| Zinc oxide (vulcanization aid) | 2 |
| Thiuram compound (vulcanization promoter) | 2 |

With respect to the first intermediate transfer member, sufficient transfer efficiencies and a good image quality were obtained. Further, as a result of the continuous image formation of 10,000 sheets, a very slight crack in the intermediate transfer member, presumably attributable to the influence of ozone, was observed but did not affect resultant images thus being evaluated as a practically acceptable level.

The second intermediate transfer member was subjected to measurement of resistances R1 and R2.

The results are also shown in Table 1.

EXAMPLE 4

Two intermediate transfer members were prepared and evaluated in the same manner as in Example 1 except that the content (55 wt. %) of the tetrafluoroethylene resin powder (Dav.=0.3 μm) contained in the surface layer was changed to 23 wt. %.

As a result, sufficient transfer efficiencies and a good image quality were obtained with respect to the first intermediate transfer member. Further, as a result of the continuous image formation of 10,000 sheets, a very slight toner filming was observed on the surface of the intermediate transfer member and the transfer efficiencies were somewhat lowered when compared with those at the initial stage. However, these phenomena did not affect resultant images and were evaluated as a practically acceptable level.

The second intermediate transfer member was subjected to measurement of resistances R1 and R2.

The results are also shown in Table 1.

EXAMPLE 5

Two intermediate transfer members were prepared and evaluated in the same manner as in Example 1 except that the content (55 wt. %) of the tetrafluoroethylene resin powder (Dav.=0.3 μm) contained in the surface layer was changed to 76 wt. %.

As a result, sufficient transfer efficiencies and a good image quality were obtained with respect to the first intermediate transfer member. Further, as a result of the continuous image formation of 10,000 sheets, a very slight peeling of the surface layer was observed but did not affect resultant images, and thus it was evaluated as a practically acceptable level.

The second intermediate transfer member was subjected to measurement of resistances R1 and R2.

The results are also shown in Table 1.

EXAMPLE 6

Two intermediate transfer members were prepared and evaluated in the same manner as in Example 1 except that the tetrafluoroethylene resin powder (Dav.=0.3 μm) contained in the surface layer was changed to tetrafluoroethylene-hexafluoropropylene resin powder (Dav.=1.0 μm).

As a result, sufficient transfer efficiencies and a good image quality were obtained with respect to the first intermediate transfer member. Further, as a result of the continuous image formation of 10,000 sheets, a very slight toner filming was observed on the surface of the intermediate transfer member and the transfer efficiencies were somewhat lowered when compared with those at the initial stage. However, these phenomena did not affect the resultant images and were evaluated as a practically acceptable level.

The second intermediate transfer member was subjected to measurement of resistances R1 and R2.

The results are also shown in Table 1.

EXAMPLE 7

A rubber compound having a composition identical to that prepared in Example 1 was subjected to extrusion molding, vapor vulcanization and polishing to form a rubber belt (OD=150 mm, width (W)=320 mm, T=0.8 mm).

A surface layer paint having a composition identical to that prepared in Example 1 was applied onto the rubber belt in the same manner as in Example 1 to form two (first and second) intermediate transfer member.

The first intermediate transfer member in the form of a belt was incorporated in an electrophotographic apparatus as shown in FIG. 4 and was subjected to measurement of transfer efficiencies and observation of image quality in the same manner as in Example 1, so that sufficient transfer efficiencies and a good image quality were obtained.

Then, the first intermediate transfer member (belt form) was wound about an aluminum cylinder (OD=148.4 mm, L=320 mm, T=2 mm) and subjected to the durability test ($10^5$ revolutions) and the continuous full-color image formation of 10,000 sheets in the same manner as in Example 1. As a result, at the surface of the first intermediate transfer member, a very slight crack was observed but was evaluated as a practically acceptable level since the resultant images were not adversely affected by the crack.

The second intermediate transfer member was also wound about an aluminum cylinder (OD=148.4 mm, L=320 mm, T=2 mm) and subjected to measurement of resistances R1 and R2 in the same manner as in Example 1.

The results are summarized as in Table 1.

EXAMPLE 8

On an aluminum cylinder OD=182 mm, L=320 mm, T=3 mm), a rubber compound of the following composition was transfer-molded to prepare a roller having a 5 mm-thick base layer.

| (Rubber compound) | |
|---|---|
| NBR | 35 parts |
| Epichlorohydrin rubber | 65 parts |
| Electroconductive carbon black | 2 part |
| Paraffin oil | 3 parts |
| Calcium carbonate | 10 parts |
| Sulfur (vulcanizing agent) | 2 part |
| Zinc oxide (vulcanization aid) | 2 parts |
| Thiuram compound (vulcanization promoter) | 3 parts |

Separately, a surface layer paint of the following composition was prepared.

| (Surface layer paint) | |
|---|---|
| Polyurethane prepolymer (solid content = 35%) | 100 parts |
| Hardener (solid content = 30%) | 50 parts |
| Tetrafluoroethylene resin powder | 100 parts |
| Dispersion aid | 5 parts |
| DMF (dimethylformamide) | 120 parts |

The paint was applied by spraying onto the outer surface of the roller and dried at 80° C. for 1 hour, followed by curing (hardening) at 120° C. for 2 hours, thus effecting removal of solvent and crosslinking to form first and second intermediate transfer members each having an approximately 40 μm-thick tough surface layer. The tetrafluoroethylene powder occupied 67 wt. % of the total solid components of the surface layer.

With respect to the first intermediate transfer member, performed in the same manner as in Example 1, sufficient transfer efficiencies and a good image quality were obtained. Further, the continuous load rotation test of $10^5$ revolutions and the continuous image formation of 10,000 sheets were performed in the same manner as in Example 1. As a result, a very slight peeling of the surface layer was observed but did not affect the resultant images, thus being evaluated as a practically acceptable level.

The second intermediate transfer member was subjected to measurement of resistances R1 and R2.

The results are also shown in Table 1.

EXAMPLE 9

Two (first and second) intermediate transfer members were prepared (and evaluated in the same manner as in Example 1) except that the composition of the rubber compound was changed as follows.

| (Ingredient) | (wt. part(s)) |
|---|---|
| NBR | 5 |
| Epichlorohydrin rubber | 95 |
| Paraffin oil | 2 |
| Carbon black | 1 |
| Calcium carbonate | 10 |
| Sulfur (vulcanizing agent) | 1 |
| Zinc oxide (vulcanization aid) | 2 |
| Thiuram compound (vulcanization promoter) | 2 |

With respect to the first intermediate transfer member, sufficient transfer efficiencies and a good image quality were obtained. Further, as a result of the continuous image formation of 10,000 sheets, a peeling of the surface layer was observed and the transfer efficiencies were somewhat lowered when compared with those at the initial stage. However, these phenomena did not affect resultant images and were evaluated as a practically acceptable level.

The second intermediate transfer member was subjected to measurement of resistances R1 and R2.

The results are also shown in Table 1.

EXAMPLE 10

Two (first and second) intermediate transfer members were prepared (and evaluated in the same manner as in Example 1 except that the composition of the rubber compound was changed as follows.

| (Ingredient) | (wt. part(s)) |
|---|---|
| NBR | 95 |
| Epichlorohydrin rubber | 5 |
| Paraffin oil | 2 |
| Carbon black | 1 |
| Calcium carbonate | 10 |
| Sulfur (vulcanizing agent) | 1 |
| Zinc oxide (vulcanization aid) | 2 |
| Thiuram compound (vulcanization promoter) | 2 |

With respect to the first intermediate transfer member, sufficient transfer efficiencies and a good image quality were obtained. Further, as a result of the continuous image formation of 10,000 sheets, a crack in the intermediate transfer member, presumably attributable to the influence of ozone, and a slight hollow dropout by transfer were observed but did not affect the resultant images thus being evaluated as a practically acceptable level.

The second intermediate transfer member was subjected to measurement of resistances R1 and R2.

The results are also shown in Table 1.

EXAMPLE 11

Two intermediate transfer members were prepared and evaluated in the same manner as in Example 1 except that the content (55 wt. %) of the tetrafluoroethylene resin powder contained in the surface layer was changed to 16 wt. %.

As a result, sufficient transfer efficiencies and an almost good image quality were obtained with respect to the first intermediate transfer member. Further, as a result of the continuous image formation of 10,000 sheets, a slight toner filming was observed on the surface of the intermediate transfer member and, a slight follow dropout by transfer was confirmed. However, these phenomena did not substantially affect the resultant images and were evaluated as a practically acceptable level.

The second intermediate transfer member was subjected to measurement of resistances R1 and R2.

The results are also shown in Table 1.

EXAMPLE 12

Two intermediate transfer members were prepared and evaluated in the same manner as in Example 1 except that the content (55 wt. %) of the tetrafluoroethylene resin powder (Dav.=0.3 μm) contained in the surface layer was changed to 84 wt. %

As a result, sufficient transfer efficiencies and a good image quality were obtained with respect to the first intermediate transfer member. Further, as a result of the continuous image formation of 10,000 sheets, a slight peeling and crack were observed on the surface of the intermediate transfer member and the transfer efficiencies were somewhat lowered when compared with those at the initial stage. However, these phenomena did not affect the resultant images and were evaluated as a practically acceptable level.

The second intermediate transfer member was subjected to measurement of resistances R1 and R2.

The results are also shown in Table 1.

Comparative Example 1

Two intermediate transfer members were prepared and evaluated in the same manner as in Example 1 except that the surface layer was not formed.

As a result, at the initial state, transfer efficiencies (primary transfer efficiency=90%, secondary transfer efficiency=73%) were inferior to those in Example 1 and low-density images, presumably attributable to transfer failure, were observed, thus being evaluated as at a practically unacceptable level. For this reason, the durability test was not performed.

The results are summarized in Table 2.

Comparative Example 2

Two intermediate transfer members were prepared and evaluated in the same manner as in Example 1 except that the tetrafluoroethylene resin powder was not used.

As a result, at the initial state, transfer efficiencies (primary transfer efficiency=91%, secondary transfer efficiency=76%) were inferior to those in Example 1 and low-density images presumably attributable to transfer failure were observed, thus being evaluated as at a practically unacceptable level. For this reason, the durability test was not performed.

The results are summarized in Table 2.

TABLE 1

| Ex. No. | NBR/CHR*1 (wt. %) | F-containing resin *2 (wt. %) | R2/R1 (× $10^7$ ohm) | Initial Transfer efficiency (%) Primary | Initial Transfer efficiency (%) Secondary | Initial Image *3 quality | After durability test Transfer efficiency (%) Primary | After durability test Transfer efficiency (%) Secondary | After durability test Image *3 quality |
|---|---|---|---|---|---|---|---|---|---|
| 1 | 35/65 | 55 | 8/5 = 1.6 | 95 | 94 | A | 94 | 93 | A |
| 2 | 15/85 | 55 | 3/2 = 1.5 | 94 | 94 | A | 92 | 89 | B |
| 3 | 85/15 | 55 | 20/8 = 2.5 | 95 | 93 | A | 93 | 91 | B |
| 4 | 35/65 | 23 | 4/3 = 1.3 | 93 | 90 | B | 91 | 86 | B |
| 5 | 35/65 | 76 | 20/7 = 2.9 | 94 | 95 | A | 93 | 90 | B |
| 6 | 35/65 | 55 | 7/4 = 1.8 | 96 | 91 | A | 94 | 87 | B |
| 7 | 35/65 | 55 | 2/1 = 2.0 | 94 | 93 | A | 92 | 90 | B |
| 8 | 35/65 | 67 | 3.7/2.8 = 1.3 | 96 | 96 | A | 94 | 95 | A |
| 9 | 5/95 | 55 | 2/1 = 2.0 | 94 | 93 | A | 90 | 81 | B |
| 10 | 95/5 | 55 | 30/9 = 3.3 | 94 | 93 | A | 91 | 87 | B |
| 11 | 35/65 | 16 | 5/3 = 1.7 | 94 | 88 | B | 89 | 80 | B1 |
| 12 | 35/65 | 84 | 30/8 = 3.8 | 94 | 96 | A | 90 | 80 | B2 |

TABLE 2

| Comp. Ex. No. | NBR/CHR*1 (wt. %) | F-containing resin *2 (wt. %) | R2/R1 (× $10^7$ ohm) | Initial Transfer efficiency (%) Primary | Initial Transfer efficiency (%) Secondary | Initial Image *3 quality | After durability test Transfer efficiency (%) Primary | After durability test Transfer efficiency (%) Secondary | After durability test Image *3 quality |
|---|---|---|---|---|---|---|---|---|---|
| 1 | 35/65 | — | — | 90 | 73 | C | — | — | — |
| 2 | 35/65 | 0 | — | 91 | 76 | C | — | — | — |

(Notes for Tables 1 and 2)

*1: NBR=acrylonitrile-butadiene rubber, CHR=epichlorohydrin rubber.

*2: F-containing resin (wt. %) represented the content (wt. %) of the fluorine-containing resin powder used based on the total solid components of the surface layer.

*3: Evaluation standards were as follows.

A: Good image quality was obtained.

B: Image quality was slightly inferior to "A" but was practically acceptable.

B1: Slight hollow dropout by transfer was observed but the resultant image was at a practically acceptable level.

B2: Slight unevenness in toner transfer was observed to cause slight ununiformity of image density but the resultant image was at a practically acceptable level.

C: Image density was very low.

What is claimed is:

1. An intermediate transfer member, comprising:

at least a base layer and a surface layer, wherein the base layer comprises epichlorohydrin rubber and acrylonitrile-butadiene rubber, and the surface layer comprises urethane resin or urethane elastomer and comprises a fluorine-containing compound powder, wherein said epichlorohydrin rubber and said acrylonitrile-butadiene rubber are used in a mixing ratio (epichlorohydrin rubber: acrylonitrile-butadiene rubber) of 1:9 to 9:1 by weight.

2. A member according to claim 1, wherein said fluorine-containing compound powder is contained in an amount of 20–80 wt. % based on the surface layer.

3. A member according to claim 2, wherein said fluorine-containing compound powder is contained in an amount of 30–70 wt. % based on the surface layer.

4. A member according to claim 1, wherein said mixing ratio is 6:4 to 8:2 by weight.

5. A member according to claim 1, which exhibits a resistance R1 at an initial stage and a resistance R2 after a direct current of 5 mA is continuously applied for 5 hours per a surface area of the member of 1 $m^2$, said resistance R1 and R2 satisfying the following relationship:

$0.1 \leqq R2/R1 \leqq 10$, and $5.0\times10^4$ ohm $\leqq R2 \leqq 5.0\times10^9$ ohm.

6. A member according to claim 5, wherein said resistances R1 and R2 satisfy the following relationship:

$0.5 \leqq R2/R1 \leqq 5$.

7. A member according to claim 5, wherein said resistance R2 is in a range of $5.0\times10^5$–$1.0\times10^9$ ohm.

8. An electrophotographic apparatus, comprising:

an electrophotographic photosensitive member, charging means for charging the electrophotographic photosensitive member, imagewise exposure means for exposing imagewise the charged electrophotographic photosensitive member to form an electrostatic latent image, developing means for developing the electrostatic latent image to form a toner image on the electrophotographic photosensitive member, and an intermediate transfer member according to claim 1 for temporarily receiving the toner image by transfer from the electrophotographic photosensitive member.

9. An apparatus according to claim 8, wherein said toner image comprises plural toner images of different colors.

10. An apparatus according to claim 8, wherein said electrophotographic photosensitive member comprises at least an outermost layer comprising tetrafluoroethylene resin.

11. An apparatus according to claim 8, wherein said fluorine-containing compound powder is contained in an amount of 20–80 wt. % based on the surface layer.

12. An apparatus according to claim 8, wherein said fluorine-containing compound powder is contained in an amount of 30–70 wt. % based on the surface layer.

13. An apparatus according to claim 8, wherein said mixing ratio is 6:4 to 8:2 by weight.

14. An apparatus according to claim 8, which exhibits a resistance R1 at an initial stage and a resistance R2 after a direct current of 5 mA is continuously applied for 5 hours per a surface area of the member of 1 $m^2$, said resistance R1 and R2 satisfying the following relationship:

$0.1 \leqq R2/R1 \leqq 10$, and $5.0\times10^4$ ohm $\leqq R2 \leqq 5.0\times10^9$ ohm.

15. An apparatus according to claim 14, wherein said resistance R1 and R2 satisfy the following relationship:

$0.5 \leqq R2/R1 \leqq 5$.

16. An apparatus according to claim 14, wherein said resistance R2 is in a range of $5.0\times10^5$–$1.0\times10^9$ ohm.

* * * * *

UNITED STATES PATENT AND TRADEMARK OFFICE

CERTIFICATE OF CORRECTION

PATENT NO. : 6,144,830
DATED : November 7, 2000
INVENTOR(S) : Takashi Kusaba, et al.

It is certified that error appears in the above-identified patent and that said Letters Patent is hereby corrected as shown below:

Column 1,
Line 49, "is" should be deleted; and "detriorated," should read -- deteriorates, --.

Column 3,
Line 32, "lublicity" should read -- lubricity --.

Column 4,
Line 25, "a" should read -- an --.

Column 5,
Line 33, "increases" should read -- increase --.
Line 39, "the" should read -- a --; and "a" (1st occurrence) should read -- the --.

Column 6,
Line 50, "and" (2nd occurrence) should be deleted; and "particularly" should read -- and particularly --.

Column 12,
Line 49, "OD=182mm," should read -- (OD-182mm, --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*